US008253645B2

(12) United States Patent
Derneryd et al.

(10) Patent No.: US 8,253,645 B2
(45) Date of Patent: Aug. 28, 2012

(54) METHOD AND DEVICE FOR COUPLING CANCELLATION OF CLOSELY SPACED ANTENNAS

(75) Inventors: Anders Derneryd, Göteborg (SE); Anders Stjernman, Lindome (SE)

(73) Assignee: Telefonaktiebolaget LM Ericsson (Publ), Stockholm (SE)

( * ) Notice: Subject to any disclaimer, the term of this patent is extended or adjusted under 35 U.S.C. 154(b) by 938 days.

(21) Appl. No.: 12/298,475

(22) PCT Filed: Apr. 28, 2006

(86) PCT No.: PCT/EP2006/003961
§ 371 (c)(1),
(2), (4) Date: Oct. 24, 2008

(87) PCT Pub. No.: WO2007/124766
PCT Pub. Date: Nov. 8, 2007

(65) Prior Publication Data
US 2009/0184879 A1 Jul. 23, 2009

(51) Int. Cl.
*H01Q 1/52* (2006.01)

(52) U.S. Cl. ..... 343/853; 342/373

(58) Field of Classification Search ..... 343/853; 342/372–373, 377
See application file for complete search history.

(56) References Cited

FOREIGN PATENT DOCUMENTS
EP 001349234 A2 * 1/2003
OTHER PUBLICATIONS
J.B. Andersen et al., "Decoupling and descattering networks", IEEE Transactions on Antennas and Propagation, vol. 24(6), p. 841-846, 1976.*
Preston Geren et al "A Practical Technique for Designing Multiport Coupling Networks." IEEE Transactions on Microwave Theory and Techniques, vol. 44, No. 3, Mar. 1, 1996. XP011038361, ISSN: 0018-9480, New Jersey, US.
* cited by examiner

*Primary Examiner* — Jack W Keith
*Assistant Examiner* — Fred H Mull

(57) ABSTRACT

An antenna system comprising at least two antenna radiating elements and respective reference ports the ports being defined by a symmetrical antenna scattering N×N matrix. The system further comprises a compensating network connected to the reference ports. The compensating network is arranged for counteracting coupling between the antenna radiating elements. The compensating network is defined by a symmetrical compensating scattering 2N×2N matrix comprising four N×N blocks, the two blocks on the main diagonal containing all zeros and the other two blocks of the other diagonal containing a unitary N×N matrix and its transpose. The product between the unitary matrix, the scattering N×N matrix and the transpose of the unitary matrix equals an N×N matrix which essentially is a diagonal matrix. The present invention also relates to a method for calculating a compensating scattering 2N×2N matrix for a compensating network for an antenna system.

23 Claims, 4 Drawing Sheets

METHOD AND DEVICE FOR COUPLING CANCELLATION OF CLOSELY SPACED ANTENNAS

TECHNICAL FIELD

The present invention relates to an antenna system comprising at least two antenna elements having respective antenna radiating elements and respective reference ports, the ports being defined by a symmetrical antenna scattering N×N matrix, the system further comprising a compensating network arranged to be connected to the reference ports and having corresponding at least two network ports, the compensating network being arranged for counteracting coupling between the antenna radiating elements.

The present invention also relates to a method for calculating a compensating scattering 2N×2N matrix for a compensating network for an antenna system, where the antenna system comprises at least two antenna elements having respective antenna radiating elements and respective reference ports, where the compensating network is arranged to be connected to the reference ports and has corresponding at least two network ports, the compensating network being arranged for counteracting coupling between the antenna radiating elements, where the method comprises the step: defining the ports using a symmetrical antenna scattering N×N matrix.

The present invention also relates to a compensating network arranged to be connected to an antenna system comprising at least two antenna elements having respective antenna radiating elements and respective reference ports, the ports being defined by a symmetrical antenna scattering N×N matrix, the system further comprising to the reference ports and having corresponding at least two network ports, the compensating network being arranged for counteracting coupling between the antenna radiating elements.

BACKGROUND

The demand for wireless communication systems has grown steadily, and is still growing, and a number of technological advancement steps have been taken during this growth. In order to acquire increased system capacity and user bit rate for wireless systems by employing uncorrelated propagation paths for data streams, MIMO (Multiple Input Multiple Output) systems have been considered to constitute a preferred technology for improving the capacity.

MIMO employs a number of separate independent signal paths for data streams, for example by means of several transmitting and receiving antennas. The more signal paths that are available, the more parallel data streams may be transmitted.

Especially at the terminal side there is normally a limited volume available in the terminals used, which generally will lead to a high antenna coupling which will deteriorate the performance of the system by increased correlation between the received or transmitted signals and by decreased signal to noise ratio due to reduced efficiency of the antenna system.

There are several previously known methods to decrease the effects of coupling. According to EP 1349234, a compensation is performed on the signal by means of signal processing. This is disadvantageous, since the coupling still occurs although the coupling effects are compensated for, resulting in undesired power losses.

In general, the signals will also be even more correlated after this compensation, since the isolated antenna patterns are restored. It is a well known fact that the coupling decreases the correlation between the received signals in a Rayleigh scattering environment.

According to J. B. Andersen and H. H. Rasmussen, "Decoupling and de-scattering networks for antennas", IEEE Trans. on Antennas and Propagation, vol. AP-24, pp. 841-846, 1976, a lossless network is connected between the input ports and antenna ports of a number of antennas. This network has such properties that there is no coupling and scattering between the antennas. There are, as pointed out in the paper, some rather severe limitations. Firstly, the scattering pattern has to equal the transmit pattern, a property that only minimum scattering antennas have. Secondly, all mutual antenna impedances have to be reactive, which means that the distances between the antenna elements have specific values which may not be altered. For example, in a linear array of three monopoles, this condition cannot be fulfilled since pure reactive mutual impedances between the outer elements and between adjacent elements cannot be obtained simultaneously. As a conclusion, this prior art provides a method that only works for certain specific geometries.

Another commonly used technique at the base station to reduce antenna signal correlation is to increase the separation of the antennas, e.g. for receive diversity. This is not practical to implement in a handheld terminal.

SUMMARY

The objective problem that is solved by the present invention is to provide a method and arrangement for matching and coupling cancellation of closely spaced antennas in e.g. phones, PCs, laptops, PDAs, PCMCIA cards, PC cards and access points. The method and arrangement should admit arbitrary distances and orientations between the closely spaced antennas, and the scattering pattern should not have to equal the transmit pattern. In other words, a more general method than those previously presented is provided by means of the present invention.

This objective problem is solved by means of an antenna system according to the introduction, where further the compensating network is defined by a symmetrical compensating scattering 2N×2N matrix comprising four N×N blocks. The two blocks on the main diagonal contain all zeros, and the other two blocks of the other diagonal contain a unitary N×N matrix and its transpose, such that the product between the unitary matrix, the scattering N×N matrix and the transpose of the unitary matrix equals an N×N matrix which essentially is a diagonal matrix.

This objective problem is also solved by means of a method according to the introduction, which further comprises the steps: defining the symmetrical scattering 2N×2N matrix in such a way that it comprises four N×N blocks, the two blocks on the main diagonal containing all zeros and the other two blocks of the other diagonal containing a unitary N×N matrix and its transpose; and defining a relationship between the unitary matrix, the scattering matrix and the transpose of the unitary matrix, such that the product between the unitary matrix, the scattering matrix and the transpose of the unitary matrix equals an N×N matrix which essentially is a diagonal matrix.

This objective problem is solved by means of an antenna system according to the introduction, where further the compensating network is defined by a symmetrical compensating scattering 2N×2N matrix comprising four N×N blocks, the two blocks on the main diagonal containing all zeros and the other two blocks of the other diagonal containing a unitary N×N matrix and its transpose, such that the product between the unitary matrix, the scattering N×N matrix and the transpose of the unitary matrix equals an N×N matrix which essentially is a diagonal matrix.

According to a preferred embodiment, the diagonal matrix has elements with values that are non-negative and real, and also are singular values of the scattering N×N matrix.

According to another preferred embodiment, the compensating network ports are connected to corresponding at least one matching network.

According to another preferred embodiment, the compensating network (11), said matching network and a beam-forming network are combined to one network.

Other preferred embodiments are disclosed in the dependent claims.

Several advantages are achieved by means of the present invention, for example:

the coupling is eliminated, the compensating network is lossless, the compensating network is a passive device, requiring no external power, the antennas do not have to be of same type, and the antenna signals are de-correlated.

BRIEF DESCRIPTION OF THE DRAWINGS

The present invention will now be described more in detail with reference to the appended drawing, where.

DETAILED DESCRIPTION

In a general loss-less multi-antenna system with N ports, the power of the received or transmitted signal by an antenna port, i, is reduced by the factor 1 minus the sum of the squared magnitudes of the scattering coefficients relating to that port.

$$P_i = 1 - \sum_{j=1}^{N} |S_{ji}|^2 \tag{1}$$

In the case of transmission, this relationship is quite obvious since the reflected and coupled power is absorbed in the loads of the ports. However, due to reciprocity the same is valid when the antenna system is used for reception. Instead of being received by the other antenna ports, the energy of the incoming waves is scattered in different directions and is thus not available at any other port either.

Previous studies have shown that the complex correlation between signals from two antennas in a rich so-called Rayleigh fading environment is a function of the reflection coefficient and the coupling coefficient.

$$\rho_c = -\frac{S_{11}^* S_{12} + S_{21}^* S_{22}}{\sqrt{1 - |S_{11}|^2 - |S_{21}|^2}\sqrt{1 - |S_{12}|^2 - |S_{22}|^2}} \tag{2}$$

Hence by reducing the reflection coefficients, $S_{ii}$, and/or the coupling coefficients, $S_{ij}$, to zero of closely spaced antenna elements, the correlation between the antenna signals vanishes.

If the antenna coupling is large, the available power is decreased and the efficiency is reduced. Therefore, also the coupling must be reduced, in order to improve the performance of the multi-antenna system.

In general, this can be achieved by introducing a passive loss-less decoupling network, which cancels the coupling between the ports. The impedances of these ports will in the general case be different from each other, but since the ports do not couple to each other they can all be individually matched with loss-less matching networks. When the new ports have been matched, all the elements in the scattering matrix will be zero and the antenna signals are de-correlated and the efficiency is enhanced compared with the original antenna system.

Figure 1:
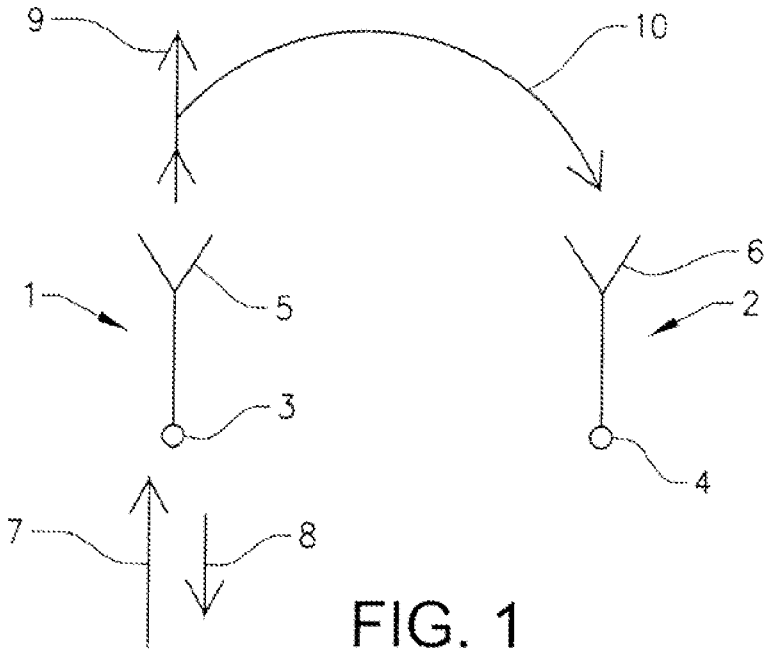
FIG. 1 shows the reflection and coupling for two antenna elements.

With reference to FIG. 1, describing a particular case, a first antenna element 1 and a second antenna element 2 are shown. The first antenna element 1 has a first antenna port 3 and a first antenna radiating element 5. Likewise, the second antenna element 2 has a second antenna port 4 and a second antenna radiating element 6. A signal 7 which is input into the first antenna port 3 is normally partially reflected, where the magnitude of the reflected signal 8 depends on how the matching of the first antenna element 1 is performed. A better matching results in a lesser reflected signal 8. The power which is not reflected at the first antenna port 3 is radiated 9 by the first antenna radiating element 5. Due to coupling between the first 5 and second 6 antenna radiating elements, which coupling increases if the distance between the antenna radiating elements 5, 6 decreases, a part 10 of the radiated power 9 is coupled into the second antenna radiating element 6, and thus that part 10 of the radiated power 9 is lost.

The same is valid for the second antenna port 4 when a signal is input into the second antenna port.

Figure 3:
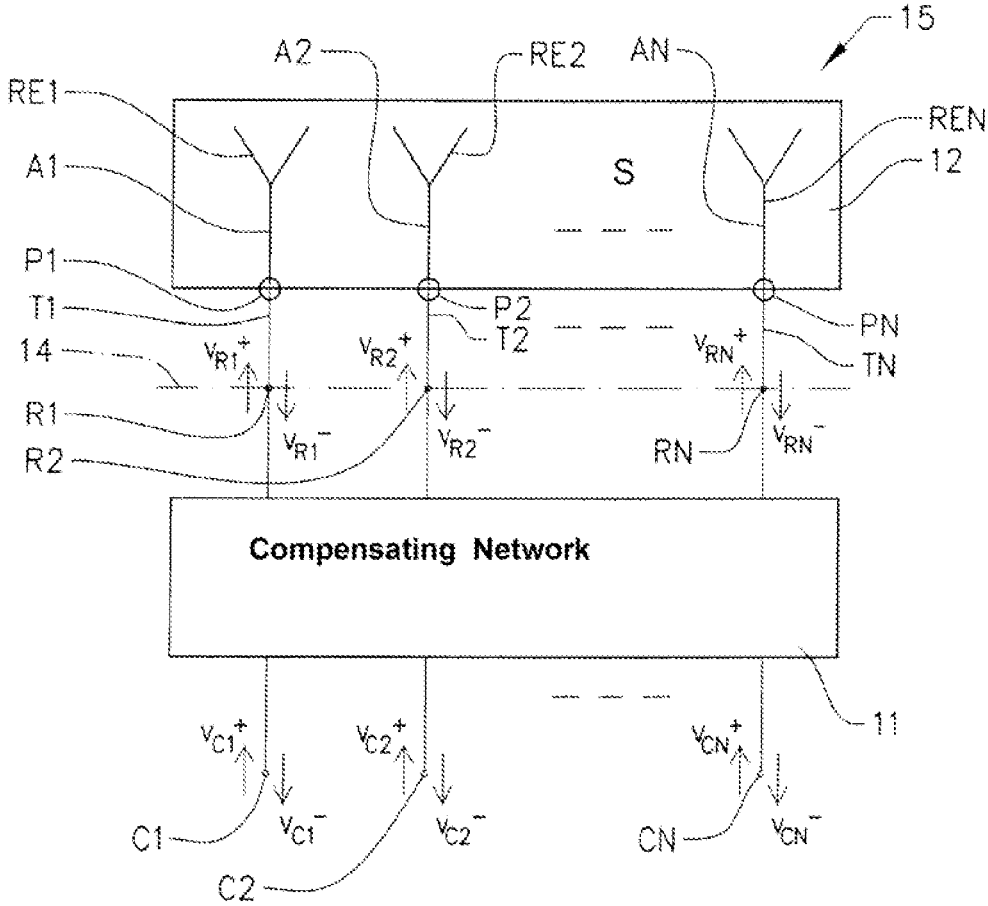
FIG. 3 shows a general compensating network according to the present invention being connected to a general set of antenna elements.

A proper layout of a compensating network 11 as shown in FIG. 3, arranged for counteracting coupling between antenna radiating elements, can be acquired by means of calculating its scattering matrix. According to the present invention, a method for calculating such a scattering matrix using so-called singular value decomposition (SVD) is provided.

Figure 2:
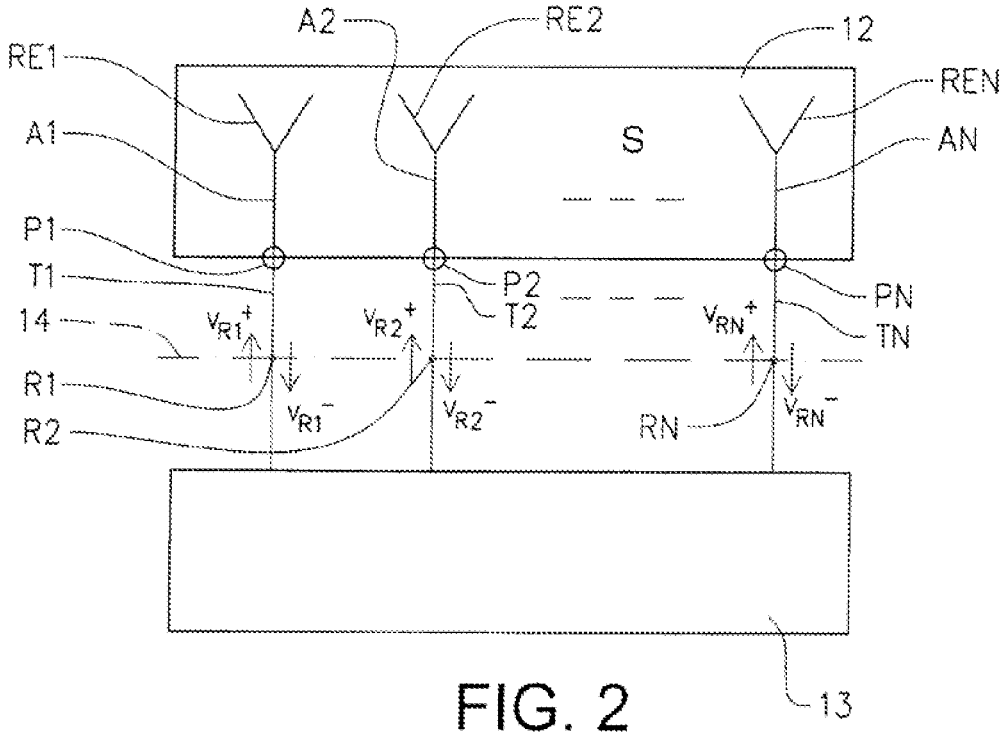
FIG. 2 shows a general set of antennas.

With reference to FIG. 2, a set 12 of antenna elements A1, A2 . . . AN, having an equal number of antenna radiating elements RE1, RE2, . . . REN and antenna ports P1, P2 . . . PN, are connected via an equal number of transmission lines T1, T2 . . . TN to a set 13 of an equal number of receivers and/or transmitters (not shown).

If the set 12 of antenna elements A1, A2 . . . AN is transmitting, exciting voltage wave amplitudes $v_{R1}^+, v_{R2}^+ \ldots v_{RN}^+$, travelling towards the antenna ports P1, P2 . . . PN, are related to reflected wave amplitudes $v_{R1}^-, v_{R2}^- \ldots v_{RN}^-$ via a complex scattering matrix S in reference ports R1, R2 . . . RN, which reference ports R1, R2 . . . RN are defined in a first reference plane 14 in each transmission line T1, T2 . . . TN. This assumes that there is no incident field on the antenna elements A1, A2 . . . AN, and that the receivers and/or transmitters have load impedances equal to the characteristic impedance of the respective transmission line T1, T2 . . . TN.

The transmission lines T1, T2 . . . TN may have an arbitrary length, should that length equal zero, the reference ports R1, R2 . . . RN would equal the antenna ports P1, P2 . . . PN. The scattering matrix S is reciprocal, i.e. it is the same irrespective of if it is a transmitting or a receiving case, i.e., the reflected voltage wave amplitudes from the receivers, travelling towards the antenna, at the first reference plane 14, are related to the incident voltage wave amplitudes, travelling towards the receiver, at the same reference plane 14, with the same scattering matrix S.

If the antenna system is built entirely of reciprocal materials, the antenna scattering matrix S will be symmetrical, i.e. it will be equal to its transpose, $S^t$. From the theory of singular value decomposition (SVD), the scattering matrix of the antenna system can be written as a product of three matrixes according to equation (3) below:

$$S=UsV^H \tag{3}$$

Here, s is a diagonal matrix and the values of the elements are non-negative and real, and also known as the singular values of the matrix S. U is a first unitary matrix and V is a second unitary matrix.

The general letter $^H$ means that a matrix is transposed and complex conjugated, $^t$ means that a matrix is transposed and * stands for a complex conjugate. The matrices U and V being unitary means that $VV^H=UU^H=I$ (I=an identity matrix). Furthermore, the columns of V are eigenvectors to $S^H S$, and the columns of U are eigenvectors to $S S^H$.

Conventionally, all matrixes are denoted with bold face upper case letters, but since S conventionally is used both for the scattering matrix in electronics and for the diagonal matrix containing the singular values in mathematics, the latter is here denoted with the bold face lower case s, and should not be confused with a vector. The matrices U and V are fetched from mathematics and have nothing to do with potentials or voltages. The columns of U and V are sometimes denoted with u and v, but it should be clear from the context when v is used for a vector of voltage amplitude values instead. When the vectors are referring to wave amplitudes, a superscript + or − sign is used.

Due to the symmetry of S, $S^H S$ is the complex conjugate of $S S^H$, and we can thereby choose U and V in such a way that U is the complex conjugate of V, i.e. U=V*. The matrixes S, U, V and s are all N×N-matrixes.

We may then write $S=V^*sV^H$. Due to the unitary property of V ($VV^H=I$), it is known that $[V^*]^{-1}=V^{*H}=V^{t**}=V^t$. Substituting U with V* in equation (3) gives $$S=V^*sV^H \tag{4}$$

Multiplication with V from the right in equation (4) yields:

$$SV=V^*sV^HV=V^*sI=V^*s \tag{5}$$

Multiplication with $[V^*]^{-1}$ from the left in equation (5) yields:

$$[V^*]^{-1}SV=[V^*]^{-1}V^*s=S \tag{6}$$

Substituting $[V^*]^{-1}$ with $V^t$ finally results in that:

$$s=V^tSV \tag{7}$$

All the limitations mentioned above are not necessary in the general case, but have been necessary to deduce equation (7) by means of SVD. Regarding equation (7) more generally, the matrix s is a diagonal matrix that may be complex and both positive and negative and of the size N×N. Furthermore, the matrix V should be of the size N×N and unitary, and the matrix S should be of the size N×N and symmetrical.

Since the matrixes U and V are unitary, U and V have orthogonal columns, and are normalized, i.e., for the matrix U:

$$\sum_{i=1}^{N} u_{in}u_{ik}^* = 0 \tag{8}$$

$$\sum_{i=1}^{N} |u_{in}|^2 = 1 \tag{9}$$

where n and k are columns and in the matrix U, n≠k, $u_{in}$, $u_{ik}$ is the element at row i, column n/k in U, and * refers to the complex conjugate. The same is valid for the matrix V.

A general well matched, isolated and loss-less distribution network from the N reference ports R1, R2, . . . RN to N compensating network 11 ports C1, C2, . . . CN can be described by four blocks of N×N matrices.

The two blocks on the main diagonal contain all zeros due to the matching and isolation condition. In addition, the reciprocity property infers symmetry, meaning that the other two blocks are each other's transpose, and the loss-less-ness infers that the blocks are unitary. Hence, a single unitary N×N-matrix V can describe a 2N×2N scattering matrix $S_c$ of any such distribution network. The blocks not being zeros are chosen as the previously discussed matrix V and its transpose $V^t$.

$$S_c = \begin{bmatrix} 0 & V \\ V^t & 0 \end{bmatrix} \tag{10}$$

In equation (10), each zero indicates a block of N×N zeros. As shown in FIG. 3, the compensating network 11 described by the scattering matrix $S_c$ is connected to the original reference ports R1, R2 . . . RN of FIG. 2. In FIG. 3, as mentioned before, the reference ports R1, R2, . . . RN equals the antenna ports P1, P2, . . . PN if the transmission lines T1, T2, . . . TN have a length that equals zero. The antenna scattering matrix S will be transformed to $V^t S V$, which is a diagonal matrix, i.e. all reference port signals are now decoupled. The compensating network 11 has ports C1, C2, . . . CN which will now excite the eigen-modes of an antenna system 15, which system 15 comprises the antennas A1, A2 . . . AN and the compensating network 11.

The working of the compensating network 11 according to FIG. 3 will now be described more in detail. The compensating network 11 is connected to the set 12 of antenna elements A1, A2 . . . AN at the reference ports R1, R2 . . . RN in the first reference plane 14. A first signal $v_{C1}^+$ that is input at the first port C1 of the compensating network 11 results in transmitted signals $v_{R1}^+$, $v_{R2}^+$ . . . $v_{RN}^+$ at the first reference ports R1, R2 . . . RN, first reflected signals $v_{R1}^-$, $v_{R2}^-$ . . . $v_{RN}^-$ at the first reference ports R1, R2. RN and a second reflected signal $v_{C1}^-$ at the first port C1 of the compensating network 11.

Generally, signals $v_{C1}^+$ $v_{C2}^+$ . . . $v_{CN}^+$ and $v_{C1}^-$, $v_{C2}^-$ . . . $v_{CN}^-$, are present at the ports C1, C2 . . . CN of the compensating network 11, and signals $v_{R1}^+$, $v_{R2}^+$ . . . $v_{RN}^+$ and $v_{R1}^-$, $v_{R2}^-$ . . . $v_{RN}^-$ are present at the reference ports R1, R2 . . . RN; each set of signals $v_{C1}^+$ $v_{C2}^+$ . . . $v_{CN}^+$; $v_{C1}^-$, $v_{C2}^-$ . . . $v_{CN}^-$; $v_{R1}^+$, $v_{R2}^+$ . . . $v_{RN}^+$; $v_{R1}^-$, $v_{R2}^-$ . . . $v_{RN}^-$ forming a corresponding vector $v_C^+$; $v_C^-$; $v_R^+$; $v_R^-$.

We may then write, starting from equation (10) above:

$$\begin{bmatrix} v_R^+ \\ v_C^- \end{bmatrix} = S_C \begin{bmatrix} v_R^- \\ v_C^+ \end{bmatrix} = \begin{bmatrix} 0 & V \\ V^t & 0 \end{bmatrix} \begin{bmatrix} v_R^- \\ v_C^+ \end{bmatrix} \tag{11}$$

We know that $$v_R^- = S v_R^+ \tag{12}$$

Combining equations (11) and (12) leads to that $$\begin{bmatrix} v_R^+ \\ v_C^- \end{bmatrix} = \begin{bmatrix} 0 & V \\ V^t & 0 \end{bmatrix} \begin{bmatrix} S v_R^+ \\ v_C^+ \end{bmatrix} \tag{13}$$

From equation (13), we acquire the further equations:

$$v_R^+ = V v_C^+ \tag{14}$$

$$v_C^- = V^t S v_R^+ \tag{15}$$

Inserting equation (14) into equation (15) leads to:

$$v_C^- = V^t S V v_C^+ \tag{16}$$

But we know that $V^t$ S V=s, therefore:

$$v_C^- = s v_C^+ \tag{17}$$

Since s is a diagonal matrix, there will be no coupling between the ports C1, C2 . . . CN. Furthermore, since $V^t$S V=s, the columns of V are eigenvectors to $S^H$ S. Since S is known, V may be derived from S. However, deriving V from S results in that many V may be found, but all of them do not satisfy $V^t$ S V=s. A script in Matlab according to the following may be used to find a V that satisfy this condition:

$$[U,s,V]=svd(S)$$

$$V=V*sqrtm(V'*\mathrm{conj}(U))$$

(In Matlab, $V^H$=V')

As a conclusion, the present invention describes a method to achieve de-correlated signals from a set of closely spaced antenna elements in order to increase the capacity in a communication network. It is for example applicable for e.g. phones, PCs, laptops, PDAs, PCMCIA cards, PC cards and access points. In particular, the present invention is advantageous for an antenna system comprising antenna elements spaced more closely than half a wavelength.

Figure 6:
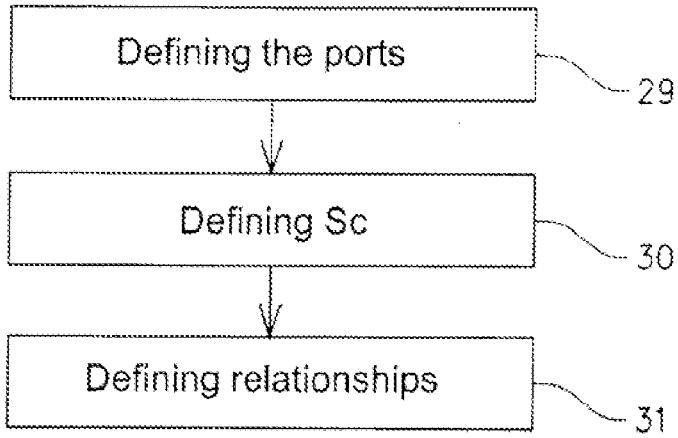
FIG. 6 shows method steps according to the present invention.

With reference to FIG. 6, the method may be summarized as a method comprising the steps:

- defining 29 the ports (R1, R2, . . . RN) using a symmetrical antenna scattering N×N matrix (S),
- defining 30 the symmetrical scattering 2N×2N matrix $S_c$ in such a way that it comprises four N×N blocks, the two blocks on the main diagonal containing all zeros and the other two blocks of the other diagonal containing a unitary N×N matrix V and its transpose $V^t$; and
- defining 31 a relationship between the unitary matrix V, the scattering matrix S and the transpose $V^t$ of the unitary matrix V, such that the product between the unitary matrix V, the scattering matrix S and the transpose $V^t$ of the unitary matrix V equals an N×N matrix s which essentially is a diagonal matrix.

The present invention can be implemented with a passive loss-less network connected to the antenna ports. With the network connected, the coupling is eliminated and the antenna signals are de-correlated.

The present invention is not limited to the example described above, but may vary freely within the scope of the appended claims. For example, the antenna elements may be of the same type or of at least two different types, e.g., dipoles, monopoles, microstrip patches, slots, loop antennas, horn antennas.

In order to improve the antenna efficiency, the matching may be enhanced in a previously known way. Then the coupling elimination is obtained without reducing the antenna efficiency.

Figure 4:
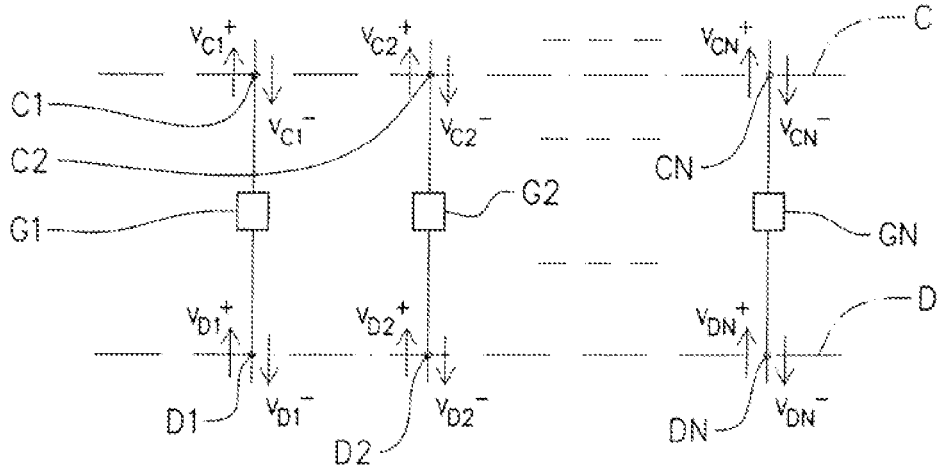
FIG. 4 shows matching networks connected to a compensating network according to the present invention.

For example, the antenna system 15 can furthermore be individually matched to essentially zero reflection, or at least a very low reflection, by means of matching networks G1, G2 . . . GN connected between the compensating network output ports C1, C2 . . . CN, formed along a second reference plane C and output ports D1, D2 . . . DN of the isolated matching networks as shown in FIG. 4, formed along a third reference plane D. At these matching network output ports D1, D2 . . . DN, corresponding input signals $v_{D1}^+$ $v_{D2}^+$ . . . $v_{DN}^+$ and output signals $v_{D1}^-$, $v_{D2}^-$ . . . $v_{DN}^-$ are present. In the same way as described previously, these signals form corresponding vectors $v_D^+$, $v_D^-$.

The compensating network (11) and the matching networks (G1, G2 . . . GN) may be combined to one network (not shown).

Depending upon the requirements of the system, e.g. fixed beams pointing in different directions, another arbitrary well-matched, isolated directional coupler such as a Butler matrix (not shown) may be connected between the output ports D1, D2 . . . DN of the isolated matching networks and the receiver or transmitter ports, without changing the matching.

In many cases the combination of the three networks can be reduced to a simpler network consisting of e.g. lumped elements, transmission line sections, waveguide sections, short-circuited stubs, open-circuited stubs, couplers, 90-degree hybrids, 180-degree hybrids and/or phase shifters. The previously mentioned set 13 of an equal number of receivers and/or transmitters as shown in FIG. 2 is preferably connected to this or these networks. Controllable beams may also be obtained, then by means of digital beam-forming in a previously known way.

For a linear array, the decoupling network depends on the coupling between antenna elements and it has to be calculated for each antenna configuration. The decoupling tends to broaden the active element patterns when the separation between the elements is small in wavelengths.

Figure 5:
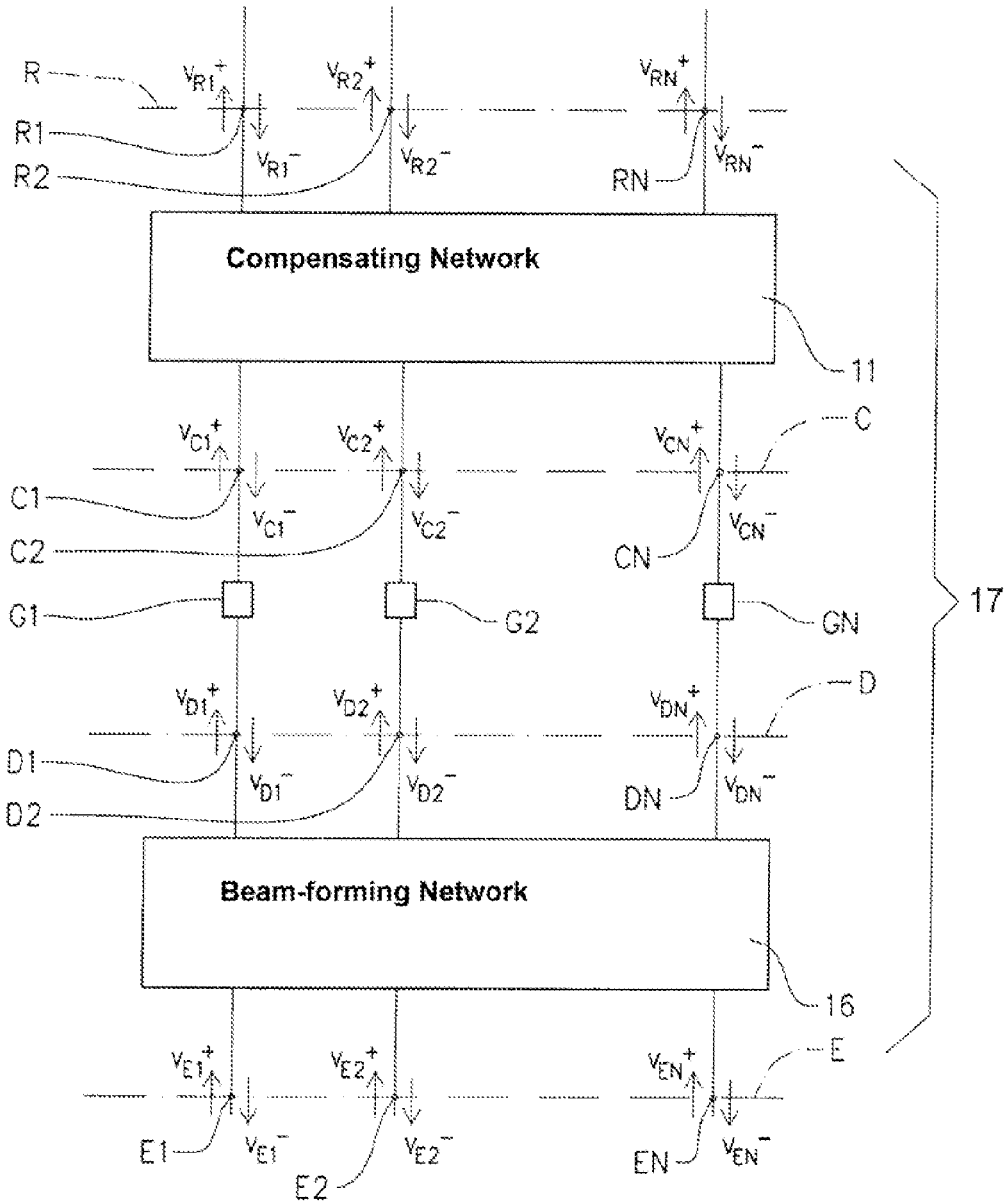
FIG. 5 shows a compensating network according to the present invention connected to matching networks, which in turn are connected to a beam-forming network.

It is possible to cascade a compensating network 11 with matching networks G1, G2 . . . GN and a beam-forming network 16 as shown in FIG. 5, and it is furthermore possible to combine these networks 11, G1, G2 . . . GN, 16 into one single network 17. In FIG. 5, a fourth reference plane E is defined, along which N single network ports E1, E2 . . . EN are formed. Corresponding input signals $v_{E1}^+$ $v_{E2}^+$ . . . $v_{EN}^+$ and output signals $v_{E1}^-$, $v_{E2}^-$ . . . $v_{EN}^-$ are present at these single network ports E1, E2 . . . EN. In the same way as described previously, these signals form corresponding vectors $v_E^+$, $v_E^-$.

Once the antennas have been decoupled, the decoupled ports can be matched with isolated matching networks described with a scattering matrix containing four blocks with diagonal N×N matrices $$\begin{pmatrix} v_C^+ \\ v_D^- \end{pmatrix} = \begin{pmatrix} s^* & (I-ss^*)^{1/2}e^{j\delta} \\ (I-ss^*)^{1/2}e^{j\delta} & -se^{j2\delta} \end{pmatrix} \begin{pmatrix} v_C^- \\ v_D^+ \end{pmatrix} \tag{19}$$

where δ is an arbitrary real diagonal matrix and $e^{j\delta}$ means the matrix exponential function of the matrix jδ which also is diagonal and representing arbitrary phase shifts depending upon the method used for matching.

Combing those relations with $v_C^- = sv_C^+$ and eliminating $v_C^+$ from $$v_C^+ = s^* s v_C^+ + (I-ss^*)^{1/2} e^{j\delta} v_D^+ \tag{20}$$

gives $$v_D^- = (I-ss)^{1/2} e^{j\delta} s v_C^+ - s e^{j2\delta} v_D^+ = (I-ss^*)^{1/2} e^{j\delta} s (I-ss^*)^{-1} (I-ss^*)^{1/2} e^{j\delta} v_D^+ - s e^{j2\delta} v_D^+ \tag{21}$$

which evaluates to zero since all matrices are diagonal and hence all products are commutative.

Forming the matrix product $$\begin{pmatrix} s^* & (I-ss^*)^{1/2}e^{j\delta} \\ (I-ss^*)^{1/2}e^{j\delta} & -se^{j2\delta} \end{pmatrix} \begin{pmatrix} s^* & (I-ss^*)^{1/2}e^{j\delta} \\ (I-ss^*)^{1/2}e^{j\delta} & -se^{j2\delta} \end{pmatrix}^H = \tag{22}$$

$$\begin{pmatrix} s^* & (I-ss^*)^{1/2}e^{j\delta} \\ (I-ss^*)^{1/2}e^{j\delta} & -se^{j2\delta} \end{pmatrix} \begin{pmatrix} s^* & (I-ss^*)^{1/2}e^{-j\delta} \\ (I-ss^*)^{1/2}e^{-j\delta} & -s^*e^{-j2\delta} \end{pmatrix} =$$

$$\begin{pmatrix} s^*s + (I-ss^*) & s^*(I-ss^*)^{1/2}e^{-j\delta} - (I-ss^*)^{1/2}e^{j\delta}s^*e^{-j2\delta} \\ (I-ss^*)^{1/2}e^{j\delta}s - se^{j2\delta} & (I-ss^*) + (-se^{j2\delta})(-s^*e^{-j2\delta}) \\ (I-ss^*)^{1/2}e^{-j\delta} & \end{pmatrix} = \begin{pmatrix} 1 & 0 \\ 0 & 1 \end{pmatrix}$$

shows that the network is lossless.

Combining the decoupling network given according to $$\begin{pmatrix} v_R^+ \\ v_C^- \end{pmatrix} = \begin{pmatrix} 0 & V \\ V^t & 0 \end{pmatrix} \begin{pmatrix} v_R^- \\ v_C^+ \end{pmatrix} \tag{23}$$

with the matching network given above and eliminating $v_C^+$ and $v_C^-$ results in the following relations:

$$\begin{pmatrix} v_R^+ \\ v_D^- \end{pmatrix} = \begin{pmatrix} Vs^*V^t & V(I-ss^*)^{1/2}e^{j\delta} \\ (I-ss^*)^{1/2}e^{j\delta}V^t & -se^{j2\delta} \end{pmatrix} \begin{pmatrix} v_R^- \\ v_D^+ \end{pmatrix}. \tag{24}$$

Since $$S = V^* s V^H, \tag{25}$$

$$I - S^H S = VV^H - Vs^* s V^H = V(I-ss^*)V^H \text{ and thus}$$

$$(I-S^H S)^{1/2} = V(I-ss^*)^{1/2}V^H, \tag{26}$$

we can rewrite those relations as $$\begin{pmatrix} v_B^+ \\ v_D^- \end{pmatrix} = \begin{pmatrix} S^* & (I-S^H S)^{1/2}Ve^{j\delta} \\ e^{j\delta}V^t(I-SS^H)^{1/2} & -e^{j\delta}V^t S V e^{j\delta} \end{pmatrix} \begin{pmatrix} v_B^- \\ v_D^+ \end{pmatrix}. \tag{27}$$

Applying a third beam-shaping or rather pattern-shaping network characterized by $$\begin{pmatrix} v_D^+ \\ v_E^- \end{pmatrix} = \begin{pmatrix} 0 & W \\ W^t & 0 \end{pmatrix} \begin{pmatrix} v_D^- \\ v_E^+ \end{pmatrix} \tag{28}$$

where W is an arbitrary unitary matrix results in scattering between the ports at reference planes R and E characterized by $$\begin{pmatrix} v_R^+ \\ v_E^- \end{pmatrix} = \begin{pmatrix} S^* & (I-S^*S)^{1/2}Ve^{j\delta}W \\ W^t e^{j\delta}V^t(I-SS^*)^{1/2} & -W^t e^{j\delta}V^t S V e^{j\delta}W \end{pmatrix} \begin{pmatrix} v_R^- \\ v_E^+ \end{pmatrix} \tag{29}$$

The product $Ve^{j\delta}W=T$ is also an arbitrary unitary matrix, hence we can write $$\begin{pmatrix} v_R^+ \\ v_E^- \end{pmatrix} = \begin{pmatrix} S^* & (I-S^*S)^{1/2}T \\ T^t(I-SS^*)^{1/2} & -T^t S T \end{pmatrix} \begin{pmatrix} v_R^- \\ v_E^+ \end{pmatrix}. \tag{30}$$

Using $v_R^- = Sv_R^+$ and solving for the voltages $v_R^+$ and $v_R^-$ render $v_R^+ = (I-S^*S)^{-1/2}Tv_E^+$ and $v_R^- = S(I-S^*S)^{-1/2}Tv_E^+$. Thus the currents at the antenna reference ports R1, R2 . . . RN are $i_R = (I-S)(I-S^*S)^{-1/2}Tv_E^+/Z_C$ where $Z_C$ is the characteristic impedance of the ports, supposed to be the same for all ports. The matrixes (I−S) and $(I-S^*S)^{-1/2}$ are both diagonally heavy, and so is the product between them, and thus choosing T=I or $W=e^{-j\delta}V^H$ gives the smallest possible distortion of the original isolated patterns, if the antenna elements are minimum scattering elements. Notice that the patterns are still distorted after matching, and that this distortion has to be accounted for, if the array antenna in question for instance is used for DOA (direction of arrival) estimation.

When there are N identical antenna elements positioned in a circular geometry at the same radius from a rotation axis and with an angular separation 2π/N between neighbouring elements and the elements are rotated with the same angle with respect to the closest neighbour, the scattering matrix S will have only N/2+1 (N even) or (N+1)/2 (N odd) unique elements, $S_0, \ldots S_{(N-1)/2}$ with $S_{ik} = S_{min(|i-k|, N-|i-k|)}$ i.e. all columns k and rows i of the matrix contain the same elements, but in a different order, the lowest element being shifted to the top of the next column, so all elements on each diagonal are identical. The subscript "min" means the minimum of the terms within the parenthesis.

$$S = \begin{bmatrix} S_0 & S_1 & S_2 & \ddots & S_1 \\ S_1 & S_0 & S_1 & \ddots & S_2 \\ S_2 & S_1 & S_0 & \ddots & \vdots \\ \ddots & \ddots & \ddots & \ddots & S_1 \\ S_1 & S_2 & \ldots & S_1 & S_0 \end{bmatrix} \tag{31}$$

Forming the matrix $X=SS^H$, all elements $X_{ik} = \Sigma S_{il} S_{kl}^*$ are real (all products between unequal elements appear in complex conjugated pairs in the sum) and $X_{ik} = X_{min(|i-k|, N-|i-k|)}$, i.e. the matrix X has the same structure as S. The eigenvectors of X form a unitary matrix U, which can be chosen to be real since X is real, and hence orthonormal. The real eigenvectors to X are also eigenvectors to S, since $$U^t U = I \Rightarrow U^* = U \Rightarrow SU = U\Lambda \Leftrightarrow S = U\Lambda U^t \Leftrightarrow S^H S = U\Lambda^H U^t U \Lambda U^t = U\Lambda^* \Lambda U^t = X \Leftrightarrow XU = U|\Lambda|^2, \tag{32}$$

where Λ is a diagonal matrix with eigenvalues and ˆ is the logical "and".

The vectors $$u_k = \left[\frac{1}{\sqrt{N}} e^{\frac{j2\pi(k-1)(l-1)}{N}}\right]_{l=1,N} \tag{33}$$

are eigenvectors to S, since $$\begin{aligned}
\sqrt{N}\, Su_k &= \left[\sum_{l=1}^{N} S_{ml} e^{j2\pi\frac{(k-1)(l-1)}{N}}\right]_{m=1,N} \\
&= \left[\sum_{l=1}^{N} S_{min(|l-m|,N-|l-m|)} e^{j2\pi\frac{(k-1)(l-1)}{N}}\right]_{m=1,N} \\
&= \left[\sum_{l=1-m}^{N-m} S_{min(|l|,N-|l|)} e^{j2\pi\frac{(k-1)(l+m-1)}{N}}\right]_{m=1,N} \\
&= \left[\sum_{l=1-m}^{-1} S_{min(-l,N+l)} e^{j2\pi\frac{(k-1)(l+m-1)}{N}} + \sum_{l=0}^{N-m} S_{min(l,N-l)} e^{j2\pi\frac{(k-1)(l+m-1)}{N}}\right]_{m=1,N} \\
&= \left[\sum_{l=N-m+1}^{N-1} S_{min(N-l,l)} e^{j2\pi\frac{(k-1)(l-N+m-1)}{N}} + \sum_{l=0}^{N-m} S_{min(l,N-l)} e^{j2\pi\frac{(k-1)(l+m-1)}{N}}\right]_{m=1,N} \\
&= \left[\sum_{l=0}^{N-1} S_{min(l,N-l)} e^{j2\pi\frac{(k-1)(l+m-1)}{N}}\right]_{m=1,N} \\
&= \sum_{l=0}^{N-1} S_{min(l,N-l)} e^{j2\pi\frac{(k-1)l}{N}} \left[e^{j2\pi\frac{(k-1)(m-1)}{N}}\right]_{m=1,N} \\
&= \sum_{l=0}^{N-1} S_{min(l,N-l)} e^{j2\pi\frac{(k-1)l}{N}} \sqrt{N}\, u_k,
\end{aligned} \tag{34}$$

since $$e^{j2\pi\frac{(k-1)(l-N+m-1)}{N}} = e^{j2\pi\frac{(k-1)(l+m-1)-(k-1)N}{N}} = e^{j2\pi\frac{(k-1)(l+m-1)}{N}-j2\pi(k-1)} = e^{j2\pi\frac{(k-1)(l+m-1)}{N}} \tag{35}$$

These eigenvectors are in general not real, hence the matrix formed by $u_k$ is not diagonalizing the matrix S. However, the eigenvectors $u_k$ and $U_{N+2-k}$, k≠1,N/2+1 have the same eigenvalue $$\sum_{l=0}^{N-1} S_{min(l,N-l)} e^{j2\pi\frac{(k-1)l}{N}} = \sum_{l=0}^{N-1} S_{min(l,N-l)} e^{j2\pi\frac{(N+1-k)l}{N}} = \sum_{l=0}^{N-1} S_{min(l,N-l)} e^{j2\pi\frac{(1-k)(N-l)}{N}} \tag{36}$$

and can be combined to another pair of orthogonal real eigenvectors $$v_k = \frac{1}{\sqrt{2}}(u_k + u_{N+2-k}) \tag{37}$$

and $$v_{N+2-k} = \frac{j}{\sqrt{2}}(u_k - u_{N+2-k})$$

with the same eigenvalue. Hence the matrix V formed by the set of vectors $v_k$ is real and thus it diagonalizes the matrix S.

Any commercial available Butler-matrix can be transformed to a network described by the matrix U with columns being equal to the eigenvectors $u_k$ by applying appropriate phase shifts at both ends of the Butler-matrix, e.g. with phase-matched cables. Hence a decoupling matrix can be achieved by applying appropriate phase shifts to any such Butler-matrix and by combining the proper output ports with 180° hybrids.

Figure 7:
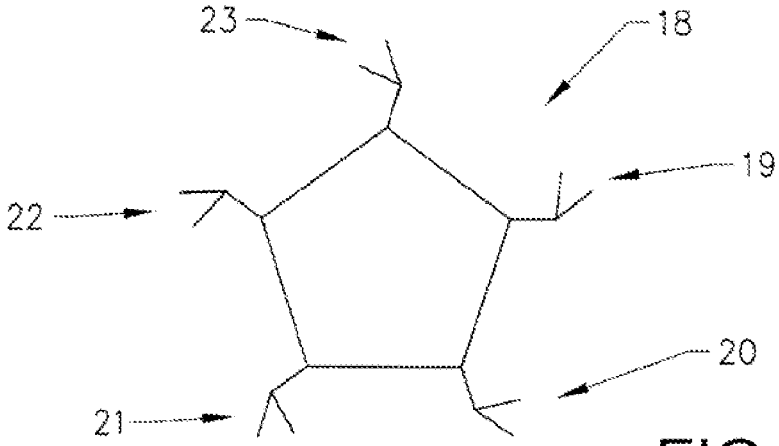
FIG. 7 shows an antenna with antenna elements positioned in a circular geometry.
Figure 8:
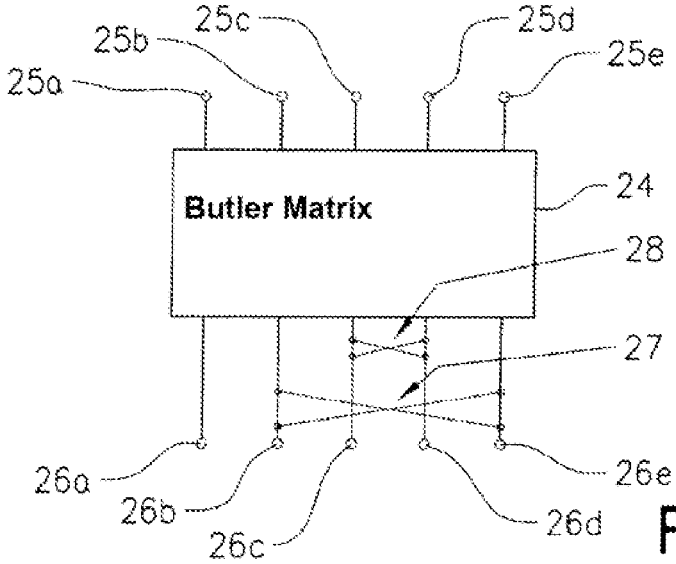
FIG. 8 shows a Butler matrix transformed to a compensating network according to the present invention.

In FIG. 7, an antenna 18 with five antenna elements 19, 20, 21, 22, 23 arranged in a circular geometry is shown. In FIG. 8, a Butler matrix 24 is having five input ports 25*a*, 25*b*, 25*c*, 25*d*, 25*e* and five output ports 26*a*, 26*b*, 26*c*, 26*d*, 26*e* is shown. A decoupling matrix for the antenna 18 may be realized by means of the Butler matrix 24 if the input ports 25*a*, 25*b*, 25*c*, 25*d*, 25*e* and the output ports 26*a*, 26*b*, 26*c*, 26*d*, 26*e* have the appropriate phase shifts, and where a second output port 26*b* and a fifth output port 26*e* are combined with a first 180° hybrid 27 and where a third output port 26*c* and a fourth output port 26*d* are combined with a second 180° hybrid 28.

The number of antenna elements for this variety having a circular variety may of course vary, the least number of antenna elements being two. The number of input ports 25*a*, 25*b*, 25*c*, 25*d*, 25*e*, the number of output ports 26*a*, 26*b*, 26*c*, 26*d*, 26*e*, the number of 180° hybrids 27, 28 and their connections to the output ports 26*a*, 26*b*, 26*c*, 26*d*, 26*e* are all in dependence of the number of antenna elements 19, 20, 21, 22, 23.

Generally, for all embodiments, the networks and antenna elements described are reciprocal, having the same function when transmitting as well as receiving.

In the description, such terms as "zero" and "diagonal matrix" are mathematical expressions which seldom or never are achieved or met in real implementations. Therefore, these terms are to be regarded as essentially achieved or met when implemented in reality. The less these terms are achieved or met, the less the coupling is counteracted.

Furthermore, the less the conducting parts are ideal and lossless, the less the coupling is counteracted.

The number of networks may vary, the matching network may for example be combined to one network only.

For all embodiments, the antenna elements may have arbitrary distances and orientations. This means that a certain equal polarization of the different antenna elements is not required, but the polarization may instead be varied arbitrary between the antenna elements.

The invention claimed is:

1. An antenna system, comprising:

at least two antenna elements having respective antenna radiating elements and respective reference ports, the reference ports being defined by a symmetrical antenna scattering N×N matrix;

a compensating network arranged to be coupled to the reference ports and having corresponding at least two network ports, the compensating network being arranged for counteracting coupling between the antenna radiating elements;

the compensating network being further defined by a symmetrical compensating scattering 2N×2N matrix comprising four N×N blocks, the two blocks on the main diagonal containing all zeros and the other two blocks of the other diagonal containing a unitary N×N matrix and its transpose, such that the product between the unitary matrix, the scattering N×N matrix and the transpose of the unitary matrix equals an N×N matrix which essentially is a diagonal matrix.

2. The antenna system according to claim 1, wherein said diagonal matrix has elements with values that are non-negative and real, and also are singular values of the scattering N×N matrix.

3. The antenna system according to claim 1, wherein the compensating network ports are connected to corresponding at least one matching network.

4. The antenna system according to claim 3, wherein the compensating network and the matching network are combined to one network.

5. The antenna system according to claim 3, wherein said matching network is connected to a beam-forming network.

6. The antenna system according to claim 5, wherein the compensating network, the matching network and the beam-forming network are combined to one network.

7. The antenna system according to claim 1, wherein the antenna system comprises at least two antenna elements arranged in a circular geometry, a Butler matrix having input ports and output ports with appropriate phase shifts applied, the number of input ports and output ports being in dependence of the number of antenna elements, where the antenna system further comprises at least one 180° hybrid connected to certain output ports in a manner which depends on the number of antenna elements, enabling the compensating network to be realized by use of the Butler matrix.

8. The antenna system according to claim 1, wherein the antenna elements are spaced less than half a wavelength apart.

9. A method for calculating a symmetrical compensating scattering 2N×2N matrix for a compensating network for an antenna system, where the antenna system has at least two antenna elements having respective antenna radiating elements and respective reference ports, where the compensating network is arranged to be coupled to the reference ports and has corresponding at least two network ports, the compensating network being arranged for counteracting coupling between the antenna radiating elements, the method comprising the steps of:

defining the ports using a symmetrical antenna scattering N×N matrix;

defining the symmetrical scattering 2N×2N matrix in such that it comprises four N×N blocks, the two blocks on the main diagonal containing all zeros and the other two blocks of the other diagonal containing a unitary N×N matrix and its transpose; and defining a relationship between the unitary matrix, the scattering matrix and the transpose of the unitary matrix, such that the product between the unitary matrix, the scattering matrix and the transpose of the unitary matrix equals an N×N matrix which essentially is a diagonal matrix.

10. The method according to claim 9, wherein said diagonal matrix has elements with values that are non-negative and real, and also are singular values of the scattering N×N matrix.

11. The method according to claim 9, wherein at least one matching network is connected to corresponding compensating network ports, and used to match the individual antenna elements to essentially zero reflection.

12. The method according to claim 11, wherein the compensating network and said matching network are combined to one network.

13. The method according to claim 11, wherein said matching network is connected to a beam-forming network, which beam-forming network is used for forming the radiation beams of the antenna elements.

14. The method according to claim 13, wherein one network is used to combine the compensating network, said matching network and the beam-forming network.

15. The method according to claim 9, wherein a Butler matrix having input ports and output ports with appropriate phase shifts applied, is used for realizing the compensating network for an antenna system comprising at least two antenna elements arranged in a circular geometry, the number of input ports and output ports being in dependence of the number of antenna elements, where at least one 180° hybrid is connected to certain output ports in a manner which depends on the number of antenna elements.

16. The method according to claim 9, wherein the antenna elements are spaced less than half a wavelength apart.

17. A compensating network arranged to be connected to an antenna system comprising:

at least two antenna elements having respective antenna radiating elements and respective reference ports, the ports being defined by a symmetrical antenna scattering N×N matrix and at least two network ports, a compensating network arranged to be coupled to the reference ports and having corresponding at least two network ports, the compensating network being arranged for counteracting coupling between the antenna radiating elements, the compensating network being defined by a symmetrical compensating scattering 2N×2N matrix comprising four N×N blocks, the two blocks on the main diagonal containing all zeros and the other two blocks of the other diagonal containing a unitary N×N matrix and its transpose, such that the product between the unitary matrix, the scattering N×N matrix and the transpose of the unitary matrix equals an N×N matrix which essentially is a diagonal matrix.

18. The compensating network according to claim 17, wherein the diagonal matrix has elements with values that are non-negative and real, and also are singular values of the scattering N×N matrix.

19. The compensating network according to claim 17, wherein the compensating network ports are connected to corresponding at least one matching network.

20. The compensating network according to claim 19, characterized wherein the compensating network and said matching network are combined to one network.

21. The compensating network according to claim 19, wherein the matching network is connected to a beam-forming network.

22. The compensating network according to claim 21, wherein the compensating network, matching network and the beam-forming network are combined to one network.

23. The compensating network according to claim 17, wherein the compensating network is realized by use of the Butler matrix having input ports and output ports with appropriate phase shifts applied, and at least one 180° hybrid connected to certain output ports, wherein the Butler matrix is connected to at least two antenna elements arranged in a circular geometry, wherein the number of input ports and output ports is in dependence of the number of antenna elements, and wherein the 180° hybrid is connected to said output ports in a manner which depends on the number of antenna elements.

* * * * *

UNITED STATES PATENT AND TRADEMARK OFFICE

CERTIFICATE OF CORRECTION

PATENT NO. : 8,253,645 B2
APPLICATION NO. : 12/298475
DATED : August 28, 2012
INVENTOR(S) : Demeryd et al.

It is certified that error appears in the above-identified patent and that said Letters Patent is hereby corrected as shown below:

In Column 9, Line 16, in Equation (21), delete " $v_D^{\cdot\cdot}=(I-ss)^{1/2}$ " and insert -- $v_D^{\cdot\cdot}=(I-ss^*)^{1/2}$ --, therefor.

In Column 11, Line 56, delete "$U_{N+2-k}$," and insert -- $u_{N+2-k}$, --, therefor.

Signed and Sealed this
Fifth Day of February, 2013

Teresa Stanek Rea
*Acting Director of the United States Patent and Trademark Office*